US010086489B2

(12) United States Patent
Liaw et al.

(10) Patent No.: US 10,086,489 B2
(45) Date of Patent: Oct. 2, 2018

(54) ELECTRIC GRINDER WITH SWITCHED RELUCTANCE MOTOR

(71) Applicant: X'POLE PRECISION TOOLS INC., Taoyuan (TW)

(72) Inventors: Yi-Jung Liaw, Taoyuan (TW); Pen Yi Liao, Taoyuan (TW)

(73) Assignee: X'POLE PRECISION TOOLS INC., Taoyuan (TW)

( * ) Notice: Subject to any disclaimer, the term of this patent is extended or adjusted under 35 U.S.C. 154(b) by 103 days.

(21) Appl. No.: 15/276,229

(22) Filed: Sep. 26, 2016

(65) Prior Publication Data

US 2018/0085884 A1 Mar. 29, 2018

(51) Int. Cl.

| | |
|---|---|
| ***B24B 23/02*** | (2006.01) |
| ***B24B 47/12*** | (2006.01) |
| ***B24B 49/10*** | (2006.01) |
| ***B24B 55/10*** | (2006.01) |

(52) U.S. Cl.

CPC ..... *B24B 23/02* (2013.01); *B24B 23/028* (2013.01); *B24B 47/12* (2013.01); *B24B 49/10* (2013.01); *B24B 55/102* (2013.01)

(58) Field of Classification Search

CPC ..... B24B 23/02; B24B 47/12; B24B 49/12; B24B 55/052; B24B 55/102; B24B 49/10

See application file for complete search history.

(56) References Cited

U.S. PATENT DOCUMENTS

| | | | | |
|---|---|---|---|---|
| 6,293,859 | B1 * | 9/2001 | Fink | B23D 45/16 451/344 |
| 8,435,096 | B2 * | 5/2013 | Chen | B23Q 11/0046 451/357 |
| D740,635 | S * | 10/2015 | Liaw | D8/62 |
| 2009/0239453 | A1 * | 9/2009 | Nordstrom | B24B 23/02 451/359 |
| 2017/0159822 | A1 * | 6/2017 | Liaw | F16J 15/3268 |

FOREIGN PATENT DOCUMENTS

| | | |
|---|---|---|
| TW | M428013 U | 5/2012 |

* cited by examiner

*Primary Examiner* — Timothy V Eley
(74) *Attorney, Agent, or Firm* — Muncy, Geissler, Olds & Lowe, P.C.

(57) ABSTRACT

An electric grinder with a switched reluctance motor comprises a body, a transmission assembly, a grinding wheel, and a dust-proof assembly. The body includes a first casing and a second casing. The transmission assembly includes a switched reluctance motor disposed in the first casing, a driving module disposed in the second casing, a transmission shaft connected with the switched reluctance motor, and an assemblage seat disposed in the transmission shaft. The assemblage seat includes an assemblage member for assembling the grinding wheel. The dust-proof assembly includes a dust-proof hood disposed in the first casing. Because of being driven by the switched reluctance motor, the electric grinder of the present invention adapts to the cases of phase failure, frequent start-stop operations, and phase inversion.

8 Claims, 6 Drawing Sheets

ELECTRIC GRINDER WITH SWITCHED RELUCTANCE MOTOR

FIELD OF THE INVENTION

The present invention relates to an electric grinder, particularly to an electric grinder with a switched reluctance motor.

BACKGROUND OF THE INVENTION

The electric grinder is a handheld polishing tool powered by electricity. The technician can use the electric grinder to polish or grind the surfaces of wooden or metallic workpieces.

A Taiwan patent No. M428013 disclosed an electric grinder, which comprises a housing, a brushless motor, a circuit board, a press-button switch, and a varistor. The housing has a first end and a second end. The first end has a head, and the second end has a handle. The handle has a press bar extending toward the first end. The brushless motor is disposed inside the head. The circuit board is disposed inside the handle and electrically connected with the brushless motor. The circuit board has a control panel disposed on the surface of the handle. The press-button switch has a press button, a limit seat and an elastic element. The press button is disposed in the handle and has a connection section extending toward the interior of the housing. The limit seat is fixed to the circuit board. The elastic element is disposed between the press button and the limit seat. The varistor is disposed in the circuit board, and one end of the varistor has an adjust lever joined with the connection section. While using the electric grinder, the user operates the press button to actuate the adjust lever to vary the resistance of the varistor, whereby the circuit board can output different powers to the brushless motor to control the rotation speed of the electric grinder.

Via reviewing the prior-art technology and the structure of ordinary electric grinders, it is found: as the brushless motor is normally a brushless DC motor, phase failure may make the electric grinder unable to operate; further, the cogging torque of the brushless DC motor is unfavorable to frequent start-stop operations and phase inversion of the electric grinder.

Therefore, how to develop an electric grinder adapted to phase failure, frequent start-stop operations and phase inversion has become a problem the manufacturers are eager to overcome.

SUMMARY OF THE INVENTION

The primary objective of the present invention is to solve the problem that the structure of a conventional electric grinder is inadaptable to phase failure, frequent start-stop operations, and phase inversion.

In order to achieve the abovementioned objective, the present invention proposes an electric grinder with a switched reluctance motor, which comprises a body, a transmission assembly, a grinding wheel, and a dust-proof assembly. The body includes a first casing and a second casing. The first casing includes a chamber thereinside. The second casing includes an accommodation room disposed corresponding to the first casing and interconnecting with the chamber. The transmission assembly includes a switched reluctance motor disposed inside the chamber; a driving module disposed inside the accommodation room and electrically connected with the switched reluctance motor to output a control signal to the switched reluctance motor; a transmission shaft coupled to the switched reluctance motor; and an assemblage seat disposed at one end of the transmission shaft, which is far away from the switched reluctance motor. The assemblage seat includes an assemblage member joined with the transmission shaft; and an airflow guiding member having a level drop with respect to the assemblage member, deviated from the axis of the transmission shaft, and rotating together with the transmission shaft to generate a heat-dissipation airflow. The grinding wheel is installed in the assemblage member and rotates with the transmission shaft. The dust-proof assembly includes a dust-proof hood disposed in the first casing, wherein a gap exists between the dust-proof hood and the grinding wheel; and a dust-exhaust pipe connected with the dust-proof hood, disposed corresponding to the second casing, and receiving a sucking airflow from a suction device. The dust-exhaust pipe includes an opening corresponding to the accommodation room and allowing the sucking airflow to dissipate heat from the driving module.

In one embodiment, the driving module includes a microcontroller generating the control signal and a driver electrically connected with the microcontroller and the switched reluctance motor and transmitting the control signal to the switched reluctance motor.

In one embodiment, the switched reluctance motor is a three-phase switched reluctance motor; the driver is a three-phase half-bridge driver or a three-phase full-bridge driver. The switched reluctance motor includes an outer stator and an inner rotator. The transmission assembly includes a plurality of photoelectric switches disposed in the first casing, facing the inner rotator, monitoring the position of the inner rotator, and outputting a monitoring signal to the driving module. The photoelectric switches are arranged circumferentially with the transmission shaft being the center, and the adjacent photoelectric switches are separated by a step angle. The driving module includes a variable-angle control mechanism and a voltage pulse-width modulation mechanism. The driving module determines whether the variable-angle control mechanism or the voltage pulse-width modulation mechanism generates the control signal according to each monitoring signal.

In one embodiment, the first casing includes at least one air inlet hole interconnecting with the chamber and allowing external air to enter the chamber. The transmission assembly includes an elastic press button, which is disposed in the first casing and pressed to trigger the driving module, and a press plate, which is pivotally coupled to the second casing, extended to the upper region of the elastic press button, and actuated to press the elastic press button.

In comparison with the conventional technology, the present invention is characterized in 1. The electric grinder is driven by the switched reluctance motor and adapted to phase failure, frequent start-stop operations, and frequent phase inversion.

2. The electric grinder dissipates heat from the chamber through the airflow guiding member, exhausts heat and dust from the driving module with the sucking airflow, and thus can dissipate heat of the switched reluctance motor efficiently.

DETAILED DESCRIPTION OF THE PREFERRED EMBODIMENTS

The technical contents of the present invention will be described in cooperation with drawings below.

Figure 1:
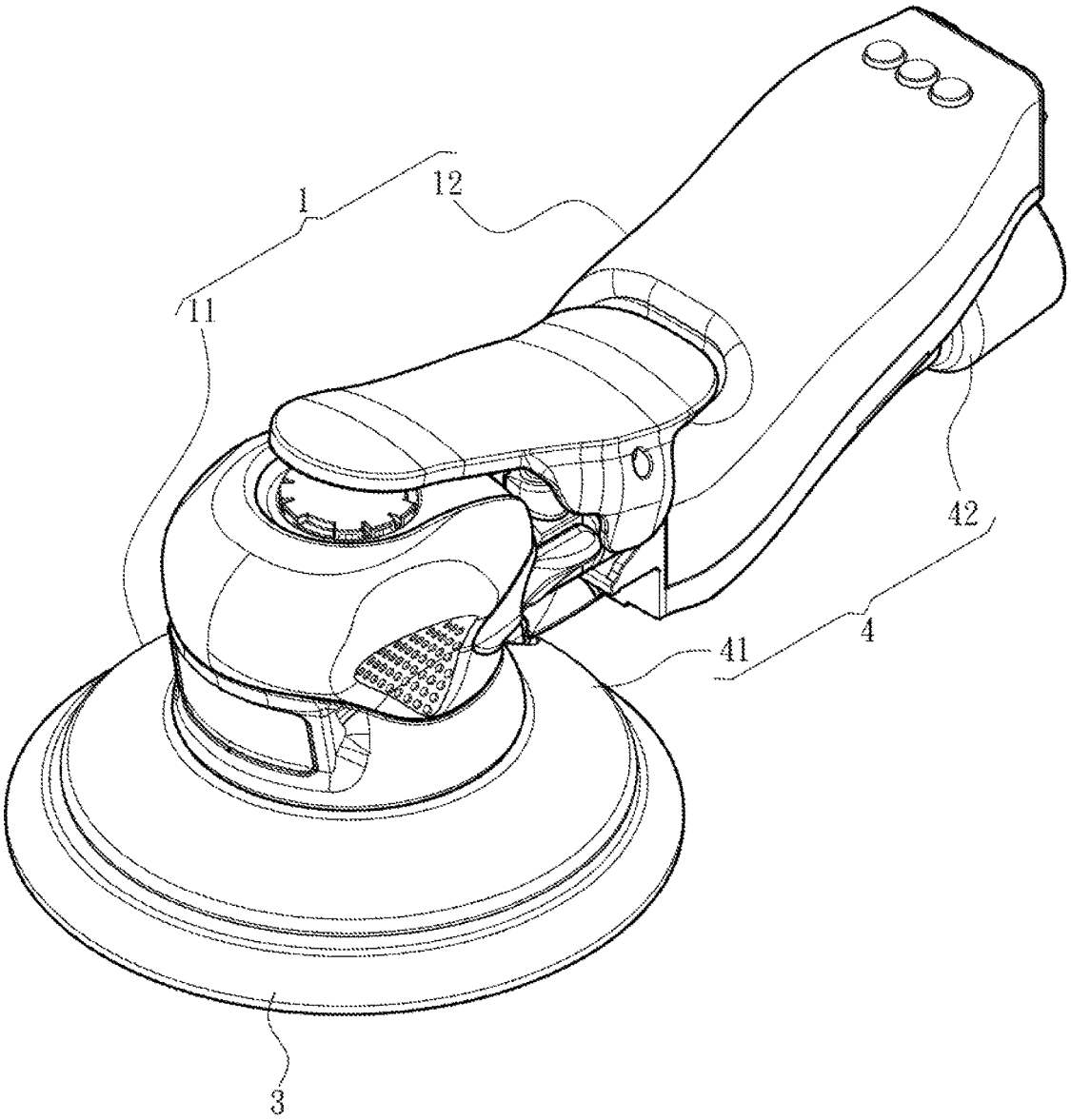
FIG. 1 is a perspective view schematically showing an electric grinder with a switched reluctance motor according to one embodiment of the present invention.
Figure 2:
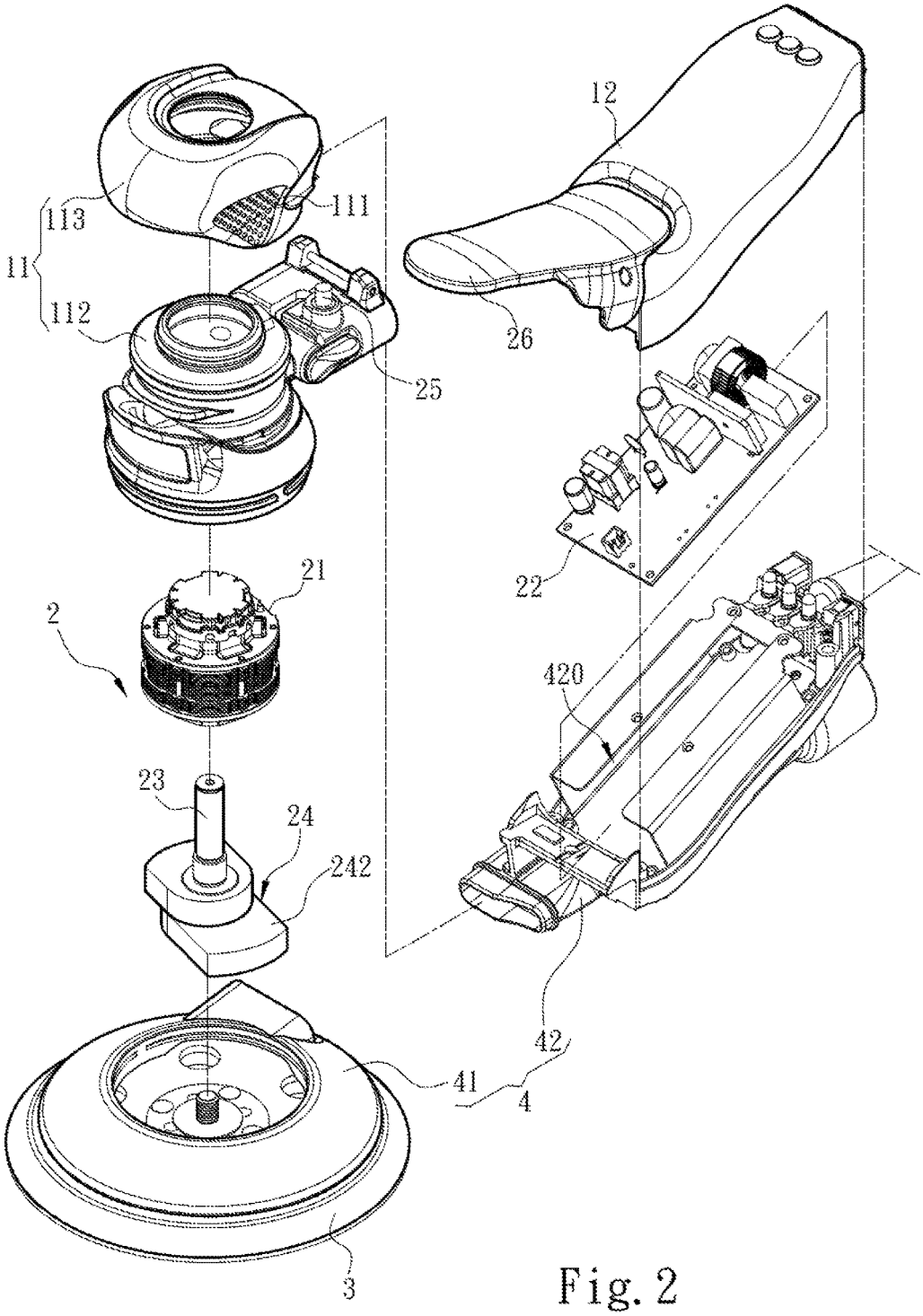
FIG. 2 is an exploded view schematically showing an electric grinder with a switched reluctance motor according to one embodiment of the present invention.
Figure 3:
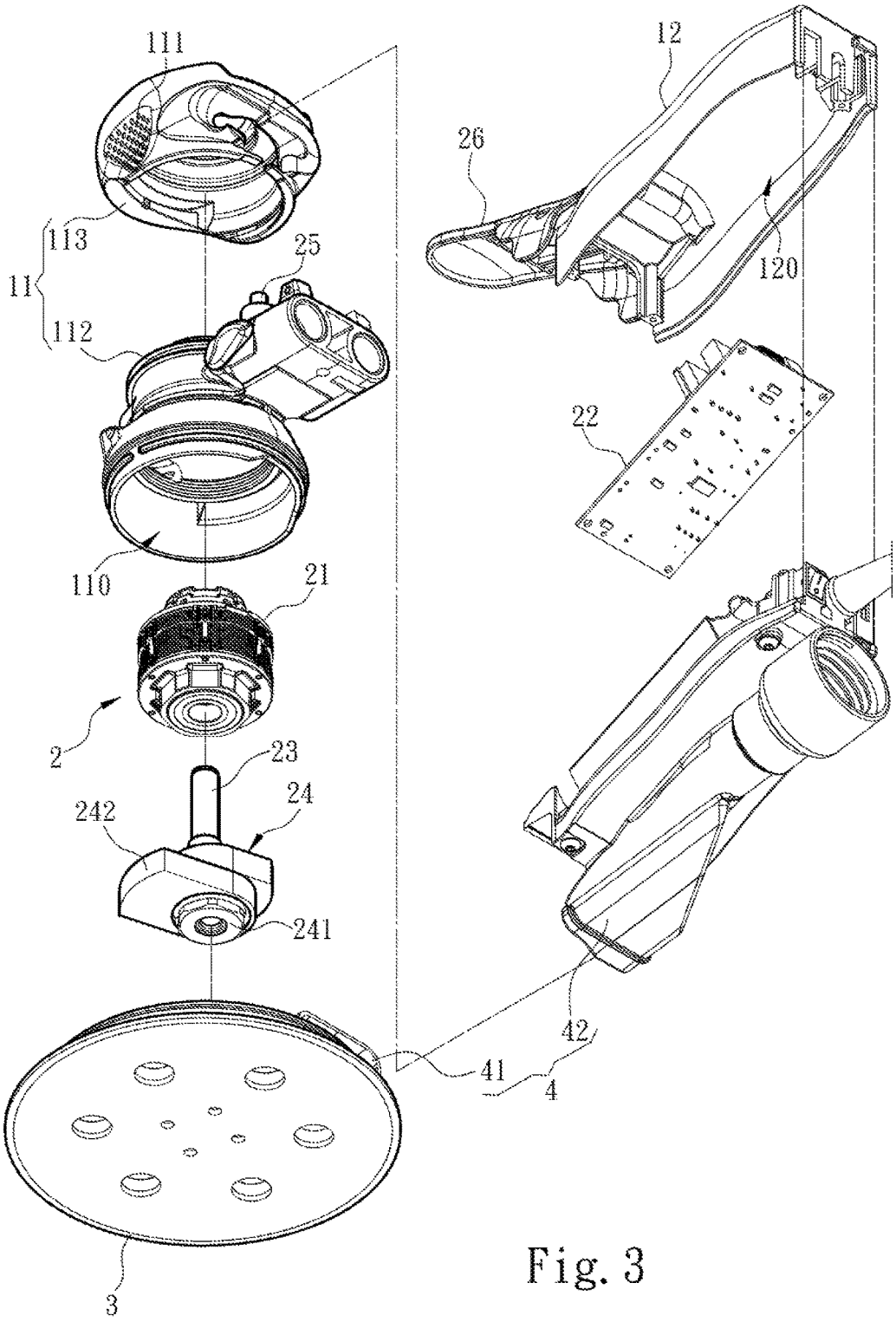
FIG. 3 is an exploded view taken from another viewing angle and schematically showing an electric grinder with a switched reluctance motor according to one embodiment of the present invention.
Figure 4:
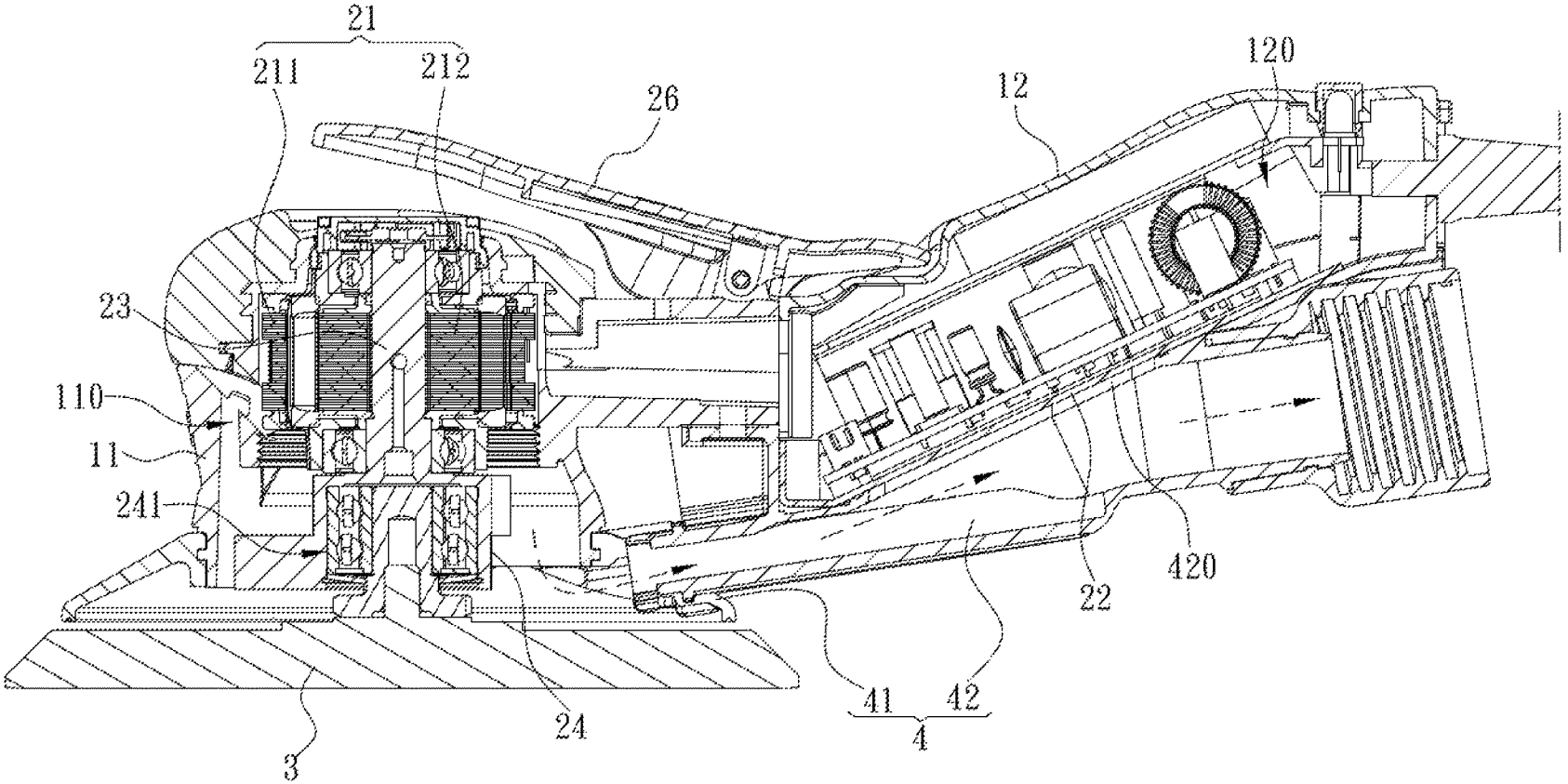
FIG. 4 is a sectional view schematically showing an electric grinder with a switched reluctance motor according to one embodiment of the present invention.
Figure 5:
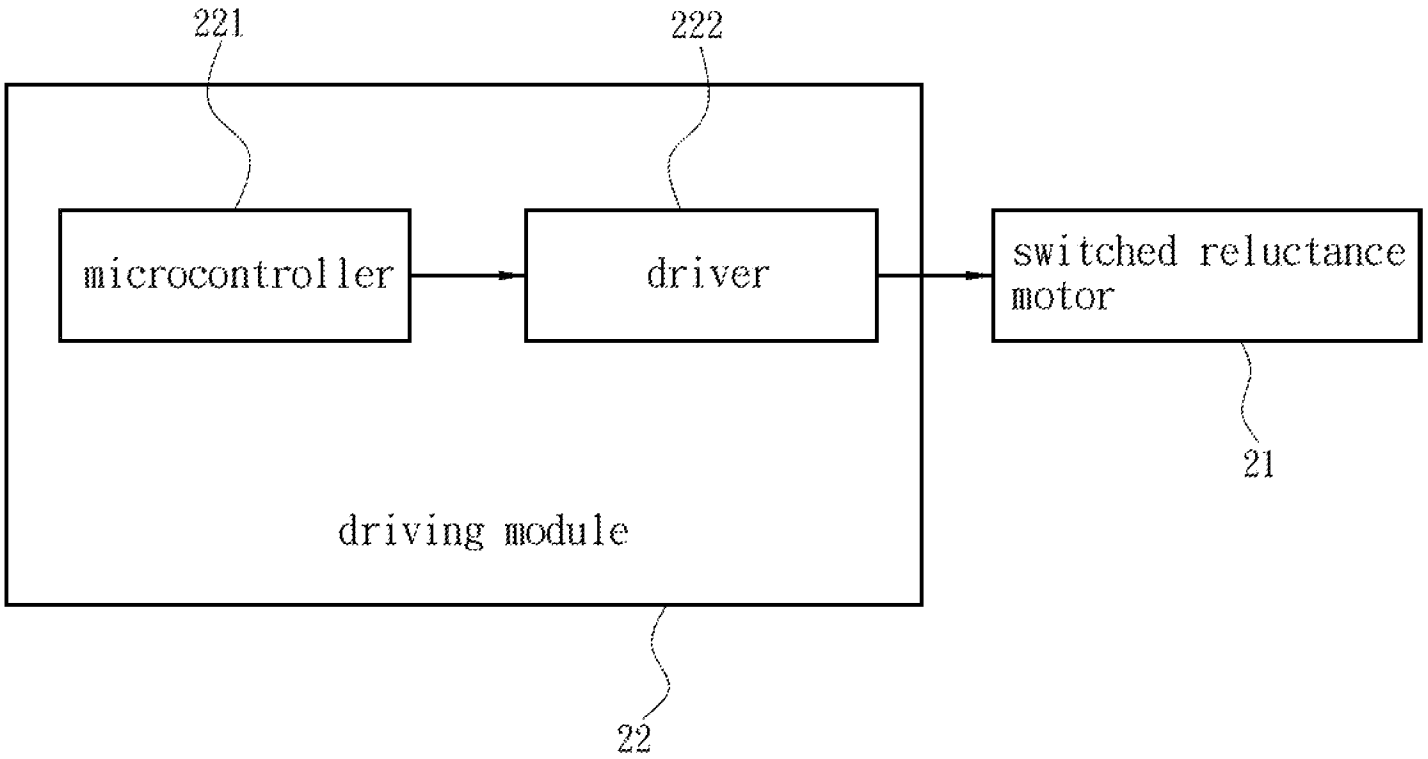
FIG. 5 is a block diagram schematically showing the circuit of a driving module according to one embodiment of the present invention.
Figure 6:
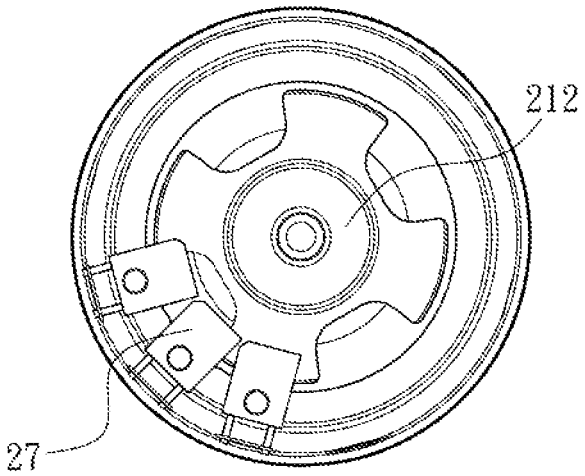
FIG. 6 is a top view schematically showing an electric grinder with a switched reluctance motor according to one embodiment of the present invention.

Refer to FIG. 1 and FIG. 2. The present invention proposes an electric grinder with a switched reluctance motor, which comprises a body 1, a transmission assembly 2, a grinding wheel 3, and a dust-proof assembly 4. The body 1 includes a first casing 11 and a second casing 12. The first casing 11 includes a chamber 110 thereinside. The second casing 12 includes an accommodation room 120 interconnecting with the chamber 110. The transmission assembly 2 includes a switched reluctance motor 21, a driving module 22, a transmission shaft 23, and an assemblage seat 24. The switched reluctance motor 21 is disposed inside the chamber 110 and includes an outer stator 211 and an inner rotator 212. Each of the outer stator 211 and the inner rotator 212 is formed via stacking a plurality of electromagnetic steel plates, such as silicon steel sheets. The driving module 22 is disposed inside the accommodation room 120 and electrically connected with the switched reluctance motor 21. In one embodiment, the chamber 110 of the first casing 11 has a column-like shape, receiving the switched reluctance motor 21. The first casing 11 includes at least one air inlet hole 111 interconnecting with the chamber 110 and allowing external air to enter the chamber 110 together with the rotation of the switched reluctance motor 21. In detail, the first casing 11 includes a primary casing 112 and a secondary casing 113 mounted to the primary casing 112. The chamber 110 is formed inside the primary casing 112. The air inlet hole 111 is formed in the secondary casing 113. The driving module 22 includes a microcontroller 221 and a driver 222 electrically connected with the microcontroller 221 and the switched reluctance motor 21. The accommodation room 120 of the second casing 12 has a long-strip shape, accommodating a circuit board (i.e. the driving module 22). In one embodiment, the switched reluctance motor 21 is a three-phase switched reluctance motor; the driver 222 is a three-phase half-bridge driver or a three-phase full-bridge driver for driving the three-phase switched reluctance motor. In one embodiment, the transmission assembly 2 includes an elastic press button 25, which is disposed in the first casing 11 and able to switch on the driving module 22 and the switched reluctance motor 21, and a press plate 26, which is pivotally coupled to the second casing 12 and extended to the upper region of the elastic press button 25. While not pressed, the elastic press button 25 is elastically restored to a preset position. The press plate 26 is pressed to actuate the elastic press button 25. The transmission shaft 23 is connected with the switched reluctance motor 21 and extended to the exterior of the first casing 11. The assemblage seat 24 is disposed at one end of the transmission shaft 23, which is far away from the switched reluctance motor 21. The assemblage seat 24 includes an assemblage member 241 and an airflow guiding member 242. The assemblage member 241 is joined with the transmission shaft 23 and deviated from the axis of the transmission shaft 23. The airflow guiding member 242 is connected with the assemblage member 241 and extended toward a direction deviated from the axis of the transmission shaft 23. In one embodiment, the airflow guiding member 242 is a protruding plate (as shown in FIG. 2). In one embodiment, the airflow guiding member 242 is at least one piece of fan blade. The grinding wheel 3 is assembled to the assemblage member 241. The dust-proof assembly 4 includes a dust-proof hood 41 and a dust-exhaust pipe 42. The dust-proof hood 41 is disposed in the first casing 11, and a gap exists between the dust-proof hood 41 and the grinding wheel 3, as shown in FIG. 4. The dust-exhaust pipe 42 is connected with the dust-proof hood 41 and includes an opening 420 corresponding to the accommodation room 120, as shown in FIG. 4.

Refer to FIGS. 1-7. In application, the driving module 22 of the electric grinder of the present invention is connected with a power supply device (not shown in the drawings) to receive the electric power for operation. Next, the user uses the press plate 26 to press the elastic press button 25 and electrically connect the driving module 22 with the switched reluctance motor 21, whereby the microcontroller 221 can transmit a control signal to the driver 222. Thus, the driver 222 drives the inner rotator 212 of the switched reluctance motor 21 to rotate the transmission shaft 23. The transmission shaft 23 further drives the grinding wheel 3 to rotate and grind the surface of an object (not shown in the drawings). Because of being driven by the switched reluctance motor 21, the electric grinder of the present invention can operate normally in the case of phase failure and thus can also operate in the cases of frequent start-stop operations and phase inversion.

Figure 7:
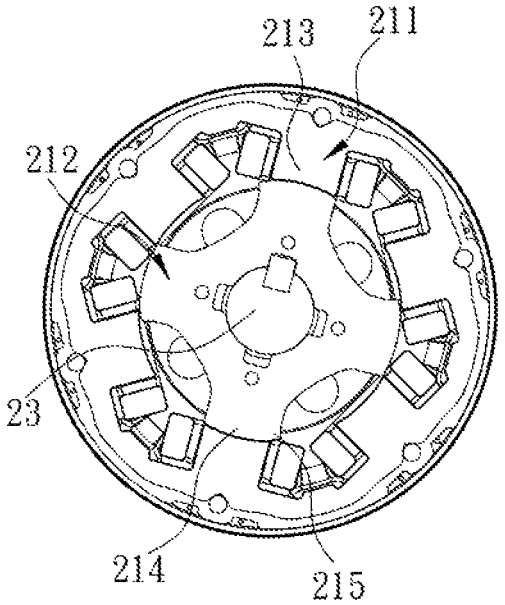
FIG. 7 is a top sectional view schematically showing an electric grinder with a switched reluctance motor according to one embodiment of the present invention.

Succeeding to the above description, the relationship between the operations of the switched reluctance motor 21 and the driving module 22 will be described in detail below. The driving module 22 includes a variable-angle control (ASR) mechanism and a voltage pulse width modulation (PWM) control mechanism. The driving module 22 will regulate the proportion of the outputs of the variable-angle control mechanism and the voltage PWM control mechanism according to the speed of the switched reluctance motor 21. The slower the speed of the switched reluctance motor 21, the higher the proportion of the output of the variable-angle control mechanism. The faster the speed of the switched reluctance motor 21, the higher the proportion of the output of the voltage pulse width modulation control mechanism. Refer to FIG. 7. Herein, it is defined beforehand herein: the inner rotator 212 rotates along a rotation direction with respect to the outer stator 211 after the inner rotator 212 has been electrically started. In one embodiment, the outer stator 211 includes a plurality of first magnetic members 213 extended toward the inner rotator 212; the inner rotator 212 includes a plurality of second magnetic members 214 extended toward the outer stator 211 and a plurality of magnetic protrusions 215 all extended toward the rotation direction. While the outer stator 211 has been magnetized, the first magnetic members 213 respectively attract the second magnetic members 214 to rotate the inner rotator 212. The design of the magnetic protrusions 215 can shorten the distance between one second magnetic member 214 and the next first magnetic member 213. Thereby, while one second magnetic member 214 has not yet rotated to the next first magnetic member 213, the switched reluctance motor 21 can induce the next first magnetic member 213 to attract the second magnetic member 214 beforehand. Therefore, the interaction of the first magnetic members 213 and the magnetic protrusions 215 can increase the rotation speed of the inner rotator 212.

In one embodiment, the transmission assembly 2 includes a plurality of photoelectric witches 27 disposed in the first casing 11 and facing the inner rotator 212, whereby to enable the driving module 22 to detect the rotation speed of the switched reluctance motor 21. The photoelectric switches 27 are used to determine the position and speed of the inner rotator 212 according to the position and frequency at which the inner rotator 212 shields the light beams. According to the position and speed of the inner rotator 212, a monitoring signal is transmitted to the driving module 22. According to the monitoring signal of each photoelectric switch 27, the driving module 22 determines the proportion of the outputs of the variable-angle control mechanism and the voltage pulse width modulation control mechanism. In one embodiment, the photoelectric switches 27 are arranged circumferentially with the transmission shaft 23 being the center, and the adjacent photoelectric switches 27 are separated by a step angle. In other words, an included angle, such as an included angle of 30 degrees, exist among the transmission shaft 23 and any two photoelectric switches 27. In addition to using the monitoring signals provided by the photoelectric switches 27 to determine the position and speed of the inner rotator 212, the microcontroller 221 also uses the driver 222 to detect the current of the switched reluctance motor 21 in one embodiment. While the current of the switched reluctance motor 21 exceeds the rated current, the driver 222 interrupts the current input to the switched reluctance motor 21 lest the overcurrent burn out the switched reluctance motor 21. In other words, the electric grinder of the present invention has an overcurrent protection function. Further, the microcontroller 221 can also switch the value of the current input to the switched reluctance motor 21 at any time according to the value of the current of the switched reluctance motor 21. While the grinding wheel 3 is retarded (such as by the surface of an object) and has a current variation, the microcontroller 221 can regulate the current input to the switched reluctance motor 21 according to the feedback of the driver 222. Hence, the switched reluctance motor 21 can always maintain a given rotation speed no matter whether the grinding wheel 3 is retarded.

Furthermore, while the electric grinder of the present invention undertakes a grinding operation, the airflow guiding member 242 is driven by the transmission shaft 23 to rotate and generate a heat-dissipation airflow to exhaust heat from the switched reluctance motor 21 to the exterior of the chamber 110. Besides, the dust-exhaust pipe 42 is connected with a suction device (not shown in the drawings), and the driving module 22 is disposed corresponding to the opening 420. While the sucking airflow generated by the suction device flows through the dust-exhaust pipe 42, the sucking airflow will take the heat and dust generated in operation out of the dust-exhaust pipe 42 simultaneously. Therefore, the electric grinder of the present invention uses the airflow guiding member 242 to exhaust heat from the chamber 110 and uses the sucking airflow to take away heat and dust from the driving module 22 simultaneously. Thus, the electric grinder of the present invention can efficiently dissipate heat from the switched reluctance motor 21 and the driving module 22.

What is claimed is:

1. An electric grinder with a switched reluctance motor, comprising a body, including a first casing and a second casing, wherein the first casing includes a chamber thereinside, and wherein the second casing is disposed corresponding to the first casing and includes an accommodation room interconnecting with the chamber;

a transmission assembly, including a switched reluctance motor disposed inside the chamber; a driving module disposed inside the accommodation room and electrically connected with the switched reluctance motor to output a control signal to the switched reluctance motor; a transmission shaft connected with the switched reluctance motor; and an assemblage seat disposed at one end of the transmission shaft, which is far away from the switched reluctance motor, wherein the assemblage seat includes an assemblage member joined with the transmission shaft and an airflow guiding member having a level drop with respect to the assemblage member and deviated from an axis of the transmission shaft, wherein the airflow guiding member is driven by the transmission shaft to rotate and generate a heat-dissipation airflow;

a grinding wheel assembled to the assemblage member and rotates together with the transmission shaft; and a dust-proof assembly, including a dust-proof hood disposed in the first casing with a gap existing between the dust-proof hood and the grinding wheel and a dust-exhaust pipe connected with the dust-proof hood and faced with the second casing, the dust-exhaust pipe including an opening corresponding to the accommodation room, wherein the dust-exhaust pipe receives a sucking airflow generated by a suction device and the opening allows the sucking airflow to dissipate heat from the driving module while the electric grinder undertakes a grinding operation.

2. The electric grinder with a switched reluctance motor according to claim 1, wherein the driving module includes a microcontroller and a driver electrically connected with the microcontroller and the switched reluctance motor, the control signal is generated by the microcontroller and transmitting the control signal to the switched reluctance motor by the driver while the electric grinder undertakes the grinding operation.

3. The electric grinder with a switched reluctance motor according to claim 2, wherein the switched reluctance motor is a three-phase switched reluctance motor; the driver is a three-phase half-bridge driver or a three-phase full-bridge driver.

4. The electric grinder with a switched reluctance motor according to claim 2, wherein the switched reluctance motor includes an outer stator and an inner rotator, and wherein the transmission assembly includes a plurality of photoelectric switches disposed in the first casing, facing the inner rotator, detecting the position of the inner rotator and outputting a monitoring signal to the driving module while the electric grinder undertakes the grinding operation.

5. The electric grinder with a switched reluctance motor according to claim 4, wherein the plurality of photoelectric switches are arranged around the transmission shaft as a center, and adjacent photoelectric switches of the plurality of photoelectric switches are separated by a step angle.

6. The electric grinder with a switched reluctance motor according to claim 5, wherein the driving module includes a variable-angle control mechanism and a voltage pulse width modulation control mechanism, and wherein the driving module determines whether the variable-angle control mechanism or the voltage pulse width modulation control mechanism generates the control signal according to the monitoring signal of each photoelectric switch.

7. The electric grinder with a switched reluctance motor according to claim 5, wherein the first casing includes at least one air inlet hole interconnecting with the chamber and allowing external air to enter the chamber.

8. The electric grinder with a switched reluctance motor according to claim 7, wherein the transmission assembly includes an elastic press button, which is disposed in the first casing and pressed to trigger the driving module; and a press plate, which is pivotally coupled to the second casing and extended to an upper region of the elastic press button, and actuated to press the elastic press button.

* * * * *